United States Patent [19]

· Vrij

[11] Patent Number: 4,748,968

[45] Date of Patent: Jun. 7, 1988

[54] GAS FIRED DEVICE FOR GENERATING HEAT FOR DWELLING

[75] Inventor: Willem J. Vrij, Ugchelen, Netherlands

[73] Assignee: Veg-Gas Instituut N.V., Apeldoorn, Netherlands

[21] Appl. No.: 37,067

[22] Filed: Apr. 10, 1987

Related U.S. Application Data

[63] Continuation of Ser. No. 757,913, Jul. 22, 1985, abandoned, which is a continuation of Ser. No. 548,216, Nov. 1, 1983, abandoned.

[30] Foreign Application Priority Data

Nov. 2, 1982 [NL] Netherlands ..... 8204251

[51] Int. Cl.[4] ..... B60H 1/02

[52] U.S. Cl. ..... 126/100; 126/345; 126/101; 237/19

[58] Field of Search ..... 126/100, 101, 345, 347, 126/350 R; 237/19.2 B; 62/230.6

[56] References Cited

U.S. PATENT DOCUMENTS

| | | | |
|---|---|---|---|
| 230,237 | 7/1880 | Campbell | 126/101 |
| 334,695 | 1/1886 | Denslow | 237/19 |
| 387,309 | 8/1888 | Mahony | 126/101 |
| 417,197 | 12/1889 | McNutt | 237/19 |
| 540,365 | 6/1895 | Randolph | 126/100 |
| 1,000,065 | 8/1911 | Armstrong | 126/100 |
| 1,762,540 | 6/1930 | Allen | 126/100 |
| 2,361,644 | 10/1944 | Mueller | 237/19 |
| 2,369,972 | 2/1945 | Meagher | 237/19 |
| 2,369,993 | 2/1945 | Turner | 126/101 |
| 2,556,170 | 6/1951 | Davidson | 126/101 |
| 2,562,023 | 7/1951 | Dufault | 126/101 |
| 2,654,361 | 10/1953 | Louching | 126/101 |
| 3,124,087 | 3/1964 | Ross | 237/19 |
| 3,404,674 | 10/1968 | Albert | 126/101 |
| 3,563,225 | 2/1971 | Masrieh | 126/101 |
| 3,763,849 | 10/1973 | Pfluger et al. | 126/101 |
| 4,010,735 | 3/1977 | Stanley et al. | 126/350 R |
| 4,124,178 | 11/1978 | Burke | 237/19 |
| 4,141,490 | 2/1979 | Franchina | 62/238.6 |
| 4,158,438 | 6/1979 | Hapgood | 126/101 |
| 4,192,457 | 3/1980 | Easterly | 126/101 |
| 4,392,610 | 7/1983 | Moskal | 126/101 |
| 4,412,526 | 11/1983 | DeGrose | 237/19 |
| 4,424,934 | 1/1984 | Wilhoite | 126/101 |
| 4,638,943 | 1/1987 | Casier et al. | 126/101 |

FOREIGN PATENT DOCUMENTS

| | | | |
|---|---|---|---|
| 7404090 | 9/1975 | France | 237/19 |

*Primary Examiner*—Samuel Scott
*Assistant Examiner*—H. A. Odar
*Attorney, Agent, or Firm*—Martin Smolowitz

[57] ABSTRACT

A gas-fired device for generating heat for a dwelling, comprising a vessel containing a liquid with an associated burner assembly for heating the liquid, an air-heat exchanger provided on a portion of the circumferential wall of the vessel, means for passing air through the heat exchanger for heating the air and a connection with means for passing the heated air to the room(s) to be heated, and a discharge for the combustion gases extending to the outside. On the remaining portion of the circumferential wall of said vessel a combustion gases-heat exchanger being mounted, so that heat is supplied to the vessel exclusively from the outside. Preferably a cooking assembly is provided above the vessel, and a condenser is mounted in the discharge channel for the combustion gases for pre-heating the air, a discharge conduit for the combustion gases from the cooking assembly being provided which leads also to said condenser. Combustion air is supplied by air inlet conduits which are connected with a channel leading to the outside of the dwelling for the supply of atmospheric air. The vessel including the burner assembly is mounted in a rectangular housing which fits in a kitchen cupboard of standard size. Preferably a heat exchanger coil or the like is immersed in the liquid inside the vessel.

17 Claims, 3 Drawing Sheets

GAS FIRED DEVICE FOR GENERATING HEAT FOR DWELLING

This application is a continuation of application Ser. No. 757,913, filed July 22, 1985, now abandoned, which is a continuation of Ser. No. 548,216 dated Nov. 1, 1983, now abandoned.

BACKGROUND OF INVENTION

The invention relates to a gas-fired device for generating heat for a dwelling, comprising a vessel containing a liquid with an associated burner assembly for heating said liquid, an air-heat exchanger provided on the outside of said vessel, means for passing air through said heat exchanger for heating said air and a connection with means for passing the heated air to the room(s) to be heated, and a discharge for the combustion gases from the burner assembly extending to the outside. Preferably the heat accumulated in the fluid inside said vessel is also utilized for heating heat exchangers which are mounted inside and/or outside of said vessel. A device of this type is known from U.S. Pat. No. 2,533,508.

A device of this type permits to heat the dwelling by means of hot air, to furnish hot water and to heat domestic appliances such as a washing mashine, all this by means of one burner assembly so that it will not be necessary to install separate devices for furnishing hot water in the dwelling, which separate devices can be either of the flow heater type and of the boiler type.

In the known device a combustion chamber is formed inside the vessel, which chamber is fed with a combustible mixture by means of a tube extending through the wall of said vessel. Said combustion chamber is connected to a tortuous passageway for the combustions gases, which extends through the interior of the vessel and which is connected to the discharge for the combustion gases through a connection passed through the wall of the vessel. In a vessel constructed this way, this vessel must have rather large dimensions in order to obtain a sufficient heat content so that the device takes up much space which obviously is a disadvantage. At any rate such a device is not suitable for being placed in a cabinet.

SUMMARY OF INVENTION

The object of the invention is to provide a gas-fired device of above-mentioned type having dimensions which are as small as possible. This object is achieved in that in the device according to the invention the interior of the vessel containing the liquid is exclusively bounded by the outer walls of said vessel, and on a portion of the circumferential side wall of said vessel a combustion gases-heat exchanger is mounted and on the remaining portion of said wall said air-heat exchanger is mounted so that heat is supplied to the vessel exclusively from the outside, and the device can be of such small design that it fits even in a kitchen-cupboard of standard size.

Therefore, a gas-fired device constructed according to the invention can advantageously comprise also a cooking assembly which preferably is provided above the vessel. In this way all heat required for a dwelling can be generated by one gas-fired device in which indeed the cooking assembly is provided with separate burners, but these burners are situated in the direct vicinity of the burner assembly provided for the remaining heat-functions for the dwelling.

Therefore, it is possible according to the invention to mount a condensor in the discharge for the combustion gases extending to the outside for pre-heating the ventilation air, and to provide a discharge conduit for the combustion gases from the cooking assembly which leads also to said condensor.

Thus, in a device constructed this way according to the invention there is required only one condenser for the generation with a high efficiency all the heat required for a dwelling, while also only one discharge channel is required for the combustion gases, so that no combustion gases at all will be permited to flow freely into the dwelling. One after another is of great importance because, on the one hand by the ever increasing fuel prices, the demand for heat-appliances having a high efficiency ever increases, it being very expensive to operate all separate gas appliances in a dwelling with a high efficiency, as high efficiences require large heat exchangers and high demands are made upon the safety means. Also on the other hand thereby the dwelling-climate upon which ever increasing demands as to the environment are made, is considerably spared.

Additionally, the burner assembly of the vessel and the burners of the cooking assembly can be provided with combustion air by means of air inlet conduits, which are connected with a ventilation channel leading to the outside of the dwelling for the supply of atmospheric air.

Thus, in this way no combustion air for the burners is taken from the dwelling. This is of importance, because the atmosphere inside the dwelling can contain elements which in practice can lead to the formation of agressive condensates containing chlorine ions.

Naturally ventilation air is required inside the dwelling. The portion of the total need of heat energy which the ventilation air consumes is increasing when the heat insulation of the dwelling is improved. In order to make also provision for this, according to the invention the channel leading to the outside of the dwelling is constructed as a ventilation channel which is interconnected with the connection means for conveying the heated air to the various rooms to be heated, the air-heat exchanger on the portion of the circumferential side wall of the vessel being disposed in a by-pass channel of said ventilation channel and a controllable valve system being provided for the regulation of the amounts of cold and heated air which are conveyed to said connection.

Preferably, said controllable valve system is formed by a balanced valve provided in the down stream outlet of the by-pass channel into the ventilation channel, between the inlet and the outlet of said by-pass channel a restricted passage being provided of which the gas flow resistance substantially equals the resistance of the by-pass channel including the air-heat exchanger accommodated thereby.

In this way the provision of heated air by the device according to the invention is based on heating the required amount of ventilation air. Hot-air heating with recirculation is mostly not necessary in well-insulated houses, but can be realized in an easy way by the provision of a closable opening in the ventilation channel. The balanced valve controlled by for instance a thermostat will see that the air emenating from the grating and into the room(s) to be heated will have the correct temperature. Thereby a very appreciated, modulating control of the hot-air heating system is obtained.

Advantageously the burners of the cooking assembly are formed by ceramic radiation burners, because the combustion gases which are formed by using the cooking assembly are also passed through the condensor so that a high operating efficiency is obtained, and the drawback is eliminated which the application of ceramic radiation burners in a cooking assembly presents, that the efficiency of these burners is rather low.

In order to be able to fully benefit from the possibilities which the application of one single gas fired appliance in the dwelling presents, preferably the burner associated with the vessel is of the same type as the burners of the cooking assembly. In this way the entire device can be adapted in a very easy way to a different kind of gas by simply adjusting the gas pressure in the conduit leading to the device for a different heating value, while the control of the supply of combustion air is kept unchanged.

This is of great importance because, besides increases of the gas price, in the future also distributed gases of different compositions are expected. Mostly a gas appliance has to be adapted for using a gas of a different composition, it being very costly to adapt each separate appliance in a dwelling.

For energy saving or other reasons, it may be of advantage to have locally a higher temperature for instance in the main living room of the dwelling in the sitting area. This can be realized in a easy way in the device according to the invention in that in the by-pass channel, downstream from the air-heat exchanger, at least one connection having a valve is provided with which a conduit is connected for the supply of hot air to such a room. Thus by a device according to the invention, all heat required for a dwelling can be generated at a high efficiency. Experiments have shown that the efficiency for a year of operation is about 9% more than for an installation in a dwelling comprising a cooking appliance having open burners, a boiler and a high efficiency hot-air heating system (95% based on calorific gross value).

An important advantage is further that the inspection by fitters and/or gas boards is very simple, as by installing a device according to the invention in the relevant dwelling only one closed gas appliance will be present.

From the Dutch patent application No. 7414651, a heating device is known comprising a vessel containing a liquid and an associated burner assembly for heating said liquid in which the air to be heated is fed from the outside by means of a ventilation channel and is passed along the outer walls of the vessel for heating the air, which ventilation channel is connected with a discharge channel for the heated air through a controllable valve system for adjusting the amounts of cold and heated air in said discharge channel. The vessel is provided with a hollow core for passing the combustion gases so that also this vessel must have rather large dimensions.

From the article "Three-purpose domestic boiler" in "Engineering" vol. 179, May 13, 1955, page 612 a heating device is known for obtaining hot air for space heating and hot water, in which also a hot plate for cooking is heated. This device is of a completely different design and comprises a fire box for solid fuel and a rather small boiler in direct contact with the fuel bed. Combustion gases from said fire box are passed over the oven and cooking plates and further through a heat exchanger for heating the air.

BRIEF DESCRIPTION OF DRAWINGS

The invention will be described in more detail by referring to the drawings in which:

FIG. 3 shows an elevation view of the heating device of the invention, including means for circulating liquid through a heat exchanger of an applicance.

DESCRIPTION OF INVENTION

Figure 1:
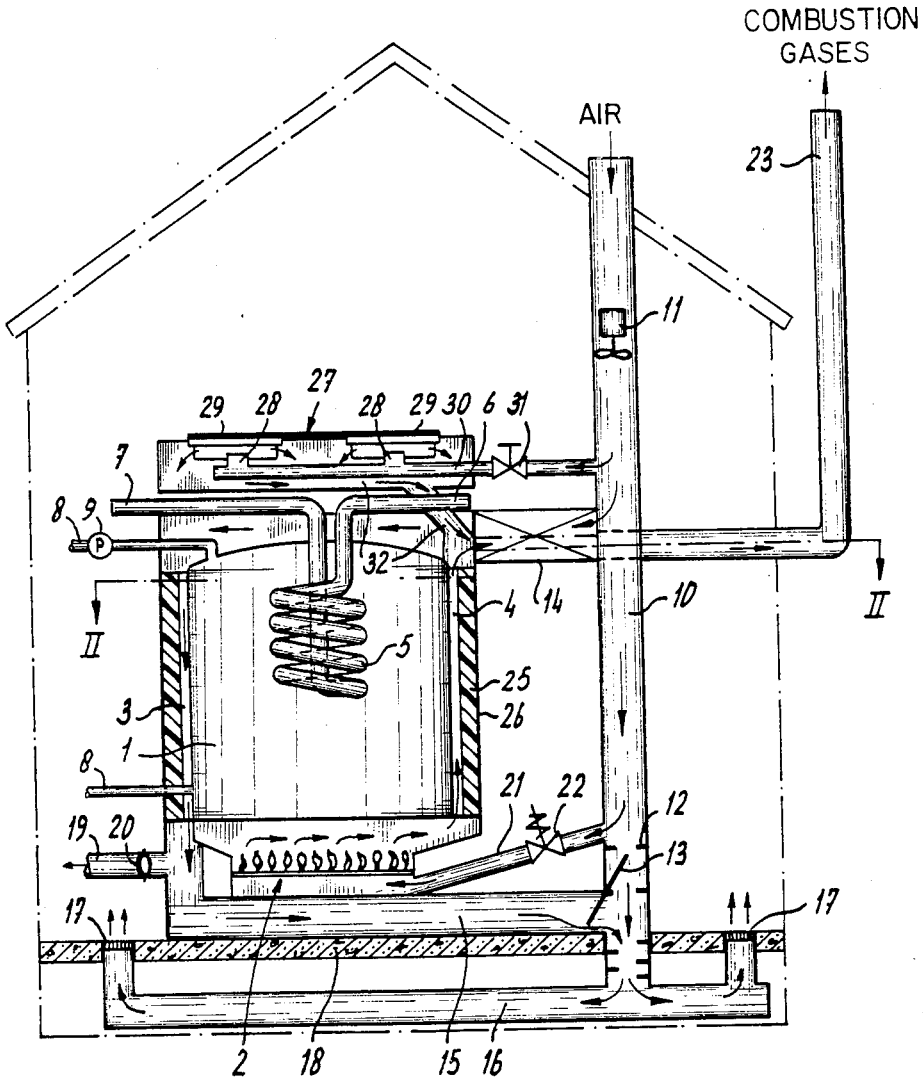
FIG. 1 shows schematically a heating device according to the invention.
Figure 2:
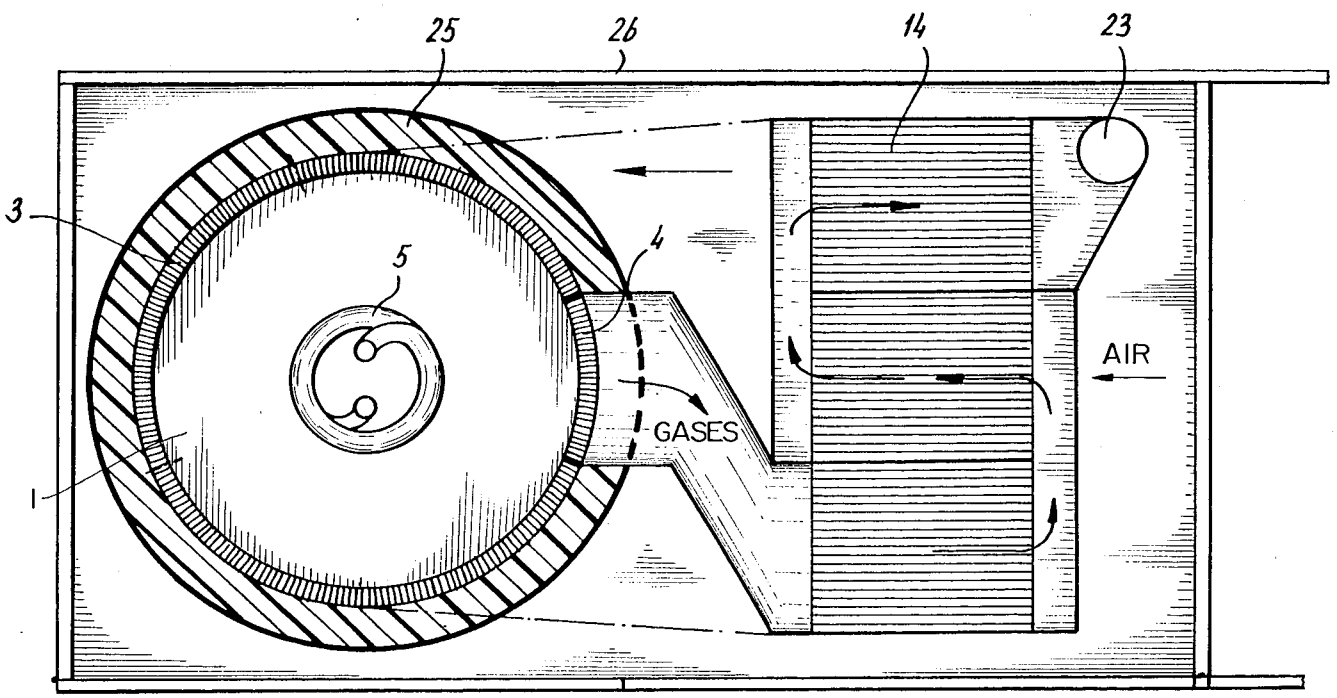
FIG. 2 shows an a cross section through the II—II in FIG. 1.
Figure 2:
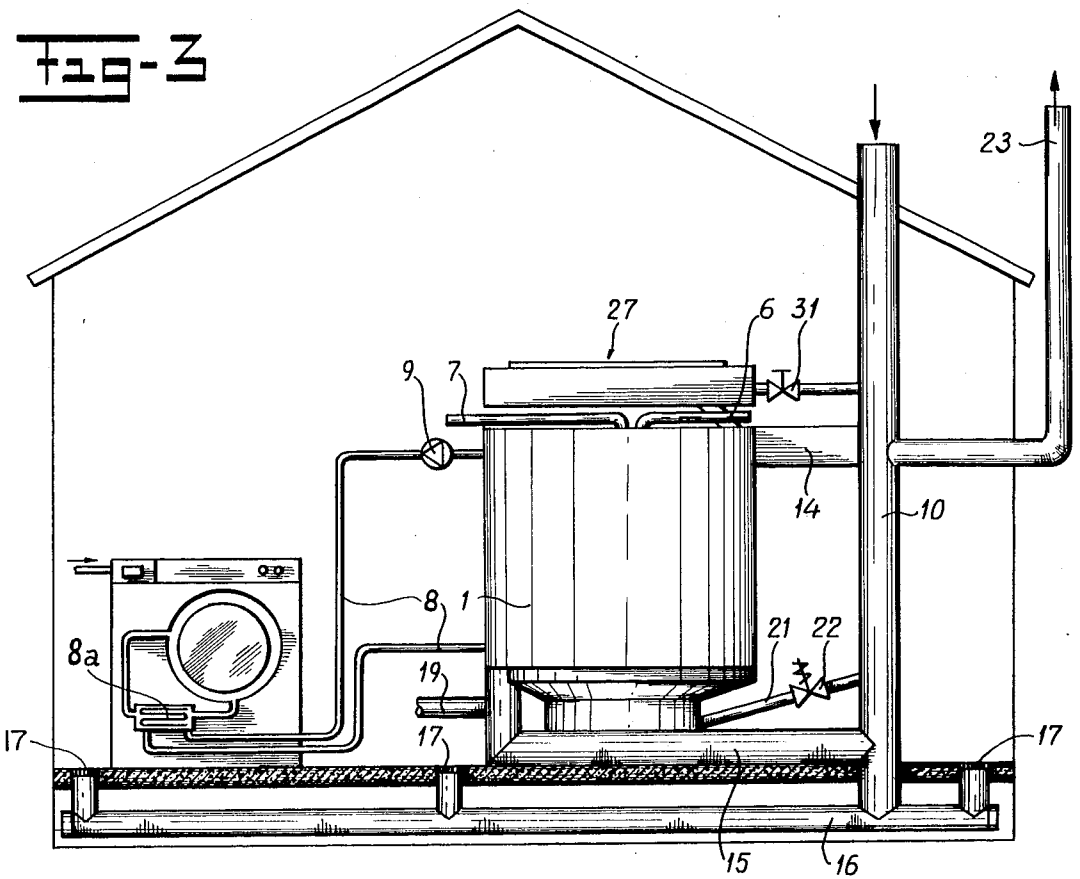

As shown in FIGS. 1 and 2 the gas-fired heating device according to the invention comprises a vessel 1 having a circumferential side wall and two end walls and which is filled with a liquid in particular water, and an associated burner 2 in particular a ceramic radiation gas burner having a on-off control which is not shown. An air-heat exchanger 3 is mounted on the greater portion of the circumferential side wall of vessel 1, and a combustion gas heat exchanger 4 is mounted on the remaining portion of said side wall between the wall and a surrounding insulation casing 25.

A heat exchanger coil 5 is immersed in the liquid inside the vessel, which coil is connected on the one side to the water main inlet conduit 6 and connected at the other side with a discharge conduit 7 which leads to one or more taps. Further, vessel 1 is provided with two connections 8 for at least one circulation conduit by means of which and by the aid of the circulation pump 9 liquid inside the vessel can be circulated through a heat exchanger of an appliance, for instance a washing machine, a dishwasher or dryer for heating said appliance, as is shown by FIG. 3.

Through the ventilation channel 10 ventilation- and combustion air is drawn in by fan 11 from above the roof of a dwelling, a restricted orifice 12 and a controllable balanced valve 13 being provided in the ventilation channel 10. In the tilted position of valve 13 as shown by FIG. 1, a portion of the ventilation air is passed through the air-combustion gas-heat exchanger or condenser 14, so that said ventilation air is pre-heated by the combustion gases from burner 2. Further said ventilation air is passed through heated air heat exchanger 3 and then flows through channel 15 to the connection with the ventilation channel 10 adjacent valve 13, at which place said heated air is mixed with a predetermined amount of cold air directly from channel 10. Then the mixture of hot and cold air flows through air distribution channels 16 to the outlet openings 17. As shown in FIG. 1, the air channels 16 are provided underneath floor 18. However, this underfloor location of distribution channel 16 is mostly not necessary in well insulated houses, so that in that case rather short channels and grates above the floow will suffice.

Valve 13 is controlled by for instance an electronic room thermostat, so that when said thermostat is not demanding heat as in summer valve 13 is in its vertical position to close channel 15. Restriction orifice 12 has a gas flow resistance which equals the flow resistance of the air-heat exchanger 3, so that in adjusting valve 13 the amount of ventilation air remains constant. By means of the connection 19 and valve 20 mounted therein, unmixed hot air can be fed from air-heat exchanger 3 and channel 15 to for instance the sitting area in a room in the dwelling being heated.

The combustion air for burner 2 is fed through first air inlet conduit 21, which is connected with ventilation channel 10 and in which air valve 22 is mounted. Vessel 1 is provided with a thermostat, (not shown), so that after a drop of the temperature of the water in vessel 1 below a predetermined temperature, air valve 22 is opened and burner 2 is ignited. Combustion gases from burner 2 flow through combustion gas heatexchanger 4 and then through condenser 14 to discharge channel 23.

For the sake of clarity, discharge 23 is shown in FIG. 1 in off-set relationship with the air ventilation channel 10. In practice these channels 10 and 23 are positioned in side by side relationship into one casing, so that a useful heat exchange between these channels will be possible. It is also possible to dispose channel 23 partially into channel 10.

Heat exchangers 3 and 4 are disposed between vessel 1 and insulating casing 25, said entire assembly with burners 2 being built-in into a rectangular shaped housing 26, which fits in the space of a kitchen-cupboard of standard size. Insulation casing 25 is also provided below burner 2 and above vessel 1, but for the sake of clarity is not shown.

Above the vessel 1, a cooking assembly 27 is mounted which is provided with ceramic radiation burners 28 which are covered by a plate 29 of ceramic material which is pervious to heat radiation and forms a pan-support. The front portion of said ceramic plate 29 serves as a warming up zone, while the plate rear portion which is heated by the combustion gases from the radiation burners disposed at the front, serves as a simmering zone. Through second inlet conduit 30 air is fed to the radiation burners 28. The conduit is connected with ventilation channel 10 and is provided with an air valve 31. Immediately before each burner inlet the fuel gas-air mixture is formed. The fuel gas-inlet having a valve and nozzle for each burner 28 is not shown. Valve 31 is opened only when the burner(s) of the cooking assembly are in operation. The operation of said burners 28 is controlled by a thermostat, so that when said thermostat is in the on-position the combustion air is continuously fed and when said thermostat is demanding no flushing period has to be awaited, but the burner can be ignited right away.

The combustion gases from the radiation heaters 28 flow through gas outlet conduit 32, through condenser 14 and then in discharge channel 23.

The gas-fired heating device according to the invention has a very high operating efficiency. This is obtained by cooling all combustion gases in a heat exchanger which is cooled by the coldest medium present, namely ventilation air drawn in from the outside. Moreover, the air supply to the combustion chambers can be closed when the burners are in the off-position and by which arrangement still-losses can be restricted.

I claim:

1. A gas-fired heating device for generating heat for a dwelling, comprising:

a vessel (1) having a circumferential side wall and two end walls, said vessel having an interior for containing a liquid and having an associated burner assembly (2) for heating the liquid in the vessel, wherein the interior of said vessel containing the liquid is bounded exclusively by the circumferential side wall and end walls of the vessel;

a combustion gas-heat exchanger (4) mounted directly on a portion of the circumferential side wall of said vessel between the vessel and a surrounding insulation casing (25) for heating the liquid in the vessel;

an air-heat exchanger (3) provided on the remaining portion of the circumferential side wall of said vessel between the vessel and the surrounding insulation casing for receiving heat from the liquid in the vessel;

air ventilation channel means (10) arranged for passing air from outside the dwelling through said air-heat exchanger (3) for heating the air, and having a first conduit (21) connected to the ventilation channel means (10) for supplying combustion air to said burner assembly (2);

heated air channel means (15) extending from said air-heat exchanger (3) with means for passing the heated air to at least one room in the dwelling to be heated; and a discharge channel (23) for combustion gases from said burner assembly (2) and extending to outside the dwelling, whereby combustion air is supplied to the burner assembly from outside the dwelling and heat is supplied from the burner assembly to the vessel and to the liquid therein exclusively from the outer walls of the vessel, so as to heat the liquid therein and thereby also heat the air drawn from outside the dwelling for heating the room in the dwelling.

2. A heating device according to claim 1, including a gas-fired cooking assembly (27) associated with and mounted above said vessel, with burners of said cooking assembly being connected to said air ventilation channel means (10) by a second inlet conduit (30) for supplying combustion air to said cooking assembly.

3. A heating device according to claim 2, wherein a condenser (14) is mounted in said discharge channel (23) for the combustion gases from said combustion gas-heat exchanger (4) for preheating ventilation air from said air ventilation channel means (10) from outside the dwelling, and a gas outlet conduit (32) is provided for combustion gases from the cooking assembly to said condenser (14).

4. A heating device according to claim 2, wherein burners of the cooking assembly (27) and the burner assembly (2) of the vessel are formed by ceramic gas radiation burners, said burners of the cooking assembly being covered by a plate (29) of ceramic material.

5. A heating device according to claim 1, wherein the ventilation channel means (10) is connected with said heated air channel means (15) for conveying heated air to the room in the dwelling to be heated, and the air-heat exchanger (3) on the portion of the circumferential side wall of the vessel (1) is disposed in a bypass channel connected to said ventilation channel means (10), a controllable valve system being provided for regulation of the amounts of cold and heated air from said ventilation channel means (10) which are conveyed to said heated air channel means (15) and to the room to be heated.

6. A heating device according to claim 5, wherein said controllable valve system is formed by a balanced valve (13) provided in a downstream outlet of the heated air channel (15) into the air ventilation channel means (10), a restricted flow passage (12) being provided in said air ventilation channel (10) between the inlet and the outlet of said bypass channel, said restricted flow passage having a gas flow resistance which substantially equals the gas flow resistance of the bypass channel.

7. A heating device according to claim 5, wherein the bypass channel downstream from the air-heat exchanger contains at least one connection (19) having a valve (20) and a conduit is connected to said valve for supply of heated air to the room in the dwelling.

8. A heating device according to claim 2, wherein said vessel including the burner assembly (2) is mounted in a rectangular housing (26).

9. A heating device according to claim 1, wherein a heat exchanger coil (5) is immersed in the liquid inside said vessel (1), which coil is connected on one side to a water main conduit (6) and is connected at its other side to a discharge conduit (7) which leads to at least one water outlet tap.

10. A heating device according to claim 1, wherein said vessel is provided with at least two connections (8) for at least one circulation conduit, by means of which the liquid inside said vessel may be circulated through a heat exchanger (8a) of an appliance located in the dwelling external to said vessel.

11. A heating device according to claim 9, wherein a cooking assembly (27) is provided mounted above said vessel, with burners of said cooking assembly being connected to said air ventilation channel means (10) by a second inlet conduit (30) for supplying combustion air to said cooking assembly.

12. A heating device according to claim 9, wherein a condenser (14) is mounted in the discharge channel (23) for the combustion gases extending from said combustion gas heat exchanger (4) for preheating ventilation air from said air ventilation channel means (10) from outside the dwelling by heat exchange with the combustion gases.

13. A gas-fired heating device for generating heat for a dwelling, comprising:

a cylindrical-shaped vessel (1) containing a liquid, said vessel having a circumferential side wall and two end walls;

a burner assembly (2) associated with said vessel and located below the vessel for heating the liquid therein;

a combustion gas-heat exchanger (4) mounted directly on a portion of the cylindrical side wall of said vessel between the vessel side wall and a surrounding insulation casing (25) for heating the liquid therein;

an air-heat exchanger (3) mounted directly on the remaining portion of the cylindrical-shaped side wall of said vessel between the vessel side wall and the surrounding insulation casing for receiving heat from the liquid in the vessel;

air ventilation channel means (10) arranged for passing air from outside the dwelling through said air-heat exchanger (3) for heating the air, and having a first conduit (21) connected to the ventilation channel means (10) for supplying combustion air to said burner assembly (2);

heater air channel (15) extending from said air heat exchanger (3) and control means for passing heated air from said air-heat exchanger to at least one room of the dwelling to be heated;

a discharge channel (23) extending from said combustion gas heat exchanger (4) to outside the dwelling for discharging the combustion gases from the burner assembly (2); and a gas-fired cooking assembly (27) provided above said vessel, with burners of said cooking assembly being connected to said channel means (10) by a second inlet conduit (30) for supplying combustion air to the cooking assembly, whereby combustion air is supplied to said burner assembly and to said cooking assembly from outside the dwelling and heat is supplied from the burner assembly to said vessel and to the liquid therein exclusively from the outer walls of the vessel, so as to heat the liquid therein and also heat the air to provide a compact thermally efficient heating unit for heating a room in the dwelling.

14. A gas-fired heating device for generating heat for a dwelling, comprising:

(a) a vessel (1) having a circumferential side wall and two end walls, said vessel containing a liquid and having an associated burner assembly (2) for heating the liquid in the vessel, the interior of said vessel containing the liquid being bounded exclusively by the outer walls of the vessel;

(b) a combustion gas-heat exchanger (4) mounted directly on a portion of the circumferential side wall of said vessel between the vessel side wall and a surrounding insulation casing (25) for heating the liquid in the vessel;

(c) an air-heat exchanger (3) mounted on the remaining portion of the circumferential side wall of said vessel between the vessel side wall and the surrounding insulation casing for receiving heat from the liquid in the vessel;

(d) ventilation air channel means (10) for passing air from outside the dwelling through said air-heat exchanger (3) for heating the air therein, and having a first inlet conduit (21) connected to said channel means (10) for supplying combustion air to said burner assembly (2);

(e) heated air channel (15) and control means from said air-heat exchanger (3) for passing heated air from the air-heat exchanger to at least one room of the dwelling to be heated;

(f) a discharge channel (23) extending from said combustion gas heat exchanger (4) to outside the dwelling for discharging the combustion gases from said burner assembly (2);

(g) a cooking assembly (27) located above said vessel;

(h) a condenser (14) mounted in said discharge channel (23) for the combustion gases from said combustion gas heat exchanger (4) for preheating incoming air from said ventilation channel (10); and (i) a discharge conduit (32) provided for the combustion gases from said cooking assembly leading to said condenser (14), whereby combustion air is supplied to said burner assembly and to said cooking assembly from outside the dwelling and heat is supplied from the burner assembly to said vessel and to the liquid therein exclusively from the outer circumferential walls of the vessel, so as to heat the liquid therein and heat the incoming air and provide a compact thermally efficient heating device for heating rooms in the dwelling.

15. A gas-fired heating device for generating heat for a dwelling, comprising:

(a) a vessel (1) having a circumferential side wall and two end walls, said vessel having an interior for containing a liquid, and having an associated burner assembly (2) for heating the liquid in the vessel, wherein the interior of said vessel is bounded exclusively by the outer walls of the vessel;

(b) a heat exchanger coil (5) immersed in the liquid inside said vessel (1), which coil is connected on one side to a water conduit (6) and is connected on its other side to a discharge conduit (7) which leads to at least one outlet tap;

(c) a combustion gas-heat exchanger (4) mounted directly on a portion of the circumferential side wall of said vessel between the vessel side wall and a surrounding insulation casing (25) for heating the liquid in the vessel;

(d) an air-heat exchanger (3) mounted on the remaining portion of the circumferential side wall of said vessel between the vessel side wall and the surrounding insulation casing for receiving heat from the liquid in the vessel;

(e) ventilation air channel means (10) for passing air from outside the dwelling through said air-heat exchanger (3) for heating the air;

(f) a heated air channel means (15) from said air-heat exchanger (30) for passing the heated air to rooms of the dwelling to be heated;

(g) a discharge channel (23) extending from said combustion gas-heat exchanger (4) to outside the dwelling for discharging the combustion gases from said burner assembly (2);

(h) a cooking assembly (27) associated with said vessel;

(i) a condenser (14) mounted in said discharge channel (23) for preheating incoming air from said ventilation channel (10);

(j) a gas outlet conduit (32) provided for the combustion gases from the cooking assembly (27) leading to said condenser (14); and (k) air inlet conduits (21, 30) connected from said ventilation channel (10) for supplying air to said burner assembly (2) associated with said vessel and to burners of said cooking assembly (27) respectively, whereby combustion air is supplied to said burner assembly (2) and to burners of said cooking assembly (27) from outside the dwelling and heat is supplied from the burner assembly to said vessel and to the liquid therein exclusively from the outer circumferential walls of the vessel, so as to heat the liquid therein and heat the incoming air and thereby provide a compact thermally efficient heating device for heating the rooms in the dwelling.

16. A heating device according to claim 9 wherein said device includes a gas-fired cooking assembly associated with and mounted above said vessel.

17. A heating device according to claim 2, wherein said cooking assembly (27) includes a second outlet conduit (32) provided for combustion gases from the cooking assembly to said condenser (14).

* * * * *